US006036569A

United States Patent [19]

Brown et al.

[11] Patent Number: 6,036,569

[45] Date of Patent: Mar. 14, 2000

[54] LAMP FABRICATING MECHANISM

[75] Inventors: Randall D. Brown, Barrington; Larry Crainich, Charlestown, both of N.H.

[73] Assignee: Osram Sylvania Inc., Danvers, Mass.

[21] Appl. No.: 09/066,154

[22] Filed: Apr. 24, 1998

Related U.S. Application Data

[60] Provisional application No. 60/046,095, May 9, 1997.

[51] Int. Cl.[7] ..... H01J 9/24

[52] U.S. Cl. ..... 445/66; 29/243.517; 29/243.57; 29/283.5

[58] Field of Search ..... 445/66, 26; 29/517, 29/243.5, 243.517, 243.57, 283.5

[56] References Cited

U.S. PATENT DOCUMENTS

| | | | |
|---|---|---|---|
| 3,728,889 | 4/1973 | McIver et al. | 29/517 |
| 5,023,505 | 6/1991 | Ratliff et al. | 445/26 |

*Primary Examiner*—Kenneth J. Ramsey
*Attorney, Agent, or Firm*—William H. McNeill

[57] ABSTRACT

A mechanism for fabricating a metalarc lamp. The metalarc lamp has a glass stem, mount frames, and a banding strap for circumferentially encompassing and binding the mount frames to the glass stem. The mechanism defines a horizontal plane for the mount frames. The banding strap is mechanically clamped about the glass stem at opposite pole centers. Then, interlocking portions of the banding strap are crimped to affix the mount frames with respect to the glass stem.

11 Claims, 3 Drawing Sheets

LAMP FABRICATING MECHANISM

This application claims the benefit of U.S. Provisional Application No. 60/046,095, filed May 9, 1997.

FIELD OF THE INVENTION

This invention relates to the fabrication of metalarc lamps and, more particularly, to a mechanism for clinching the stem strap about the glass stem supporting the mount frames in a metalarc lamp assembly.

BACKGROUND OF THE INVENTION

In the manufacture of metalarc lamps, it is necessary to properly orient and strap mount frames about a glass stem of the lamp. This banding procedure places a metal strap over the frames and the glass stem support, thus holding the mount frames, with proper orientation, about the glass stem.

The original fabrication procedure hand-crimped the metal strap, resulting in a labor-intensive method. The single strap was clinched at a single point about the glass stem and frames. In addition to being labor-intensive, this method was ineffective; the proper alignment of the frames about the glass stem was not always achieved. Another problem common to this earlier procedure was maintaining a small, compact configuration of the band around the glass stem, so that subsequent manufacturing processes could be accommodated. A further problem with the aforesaid procedure was its inability to maintain proper stem tolerances and hand crimping pressure. Stem breakage was a fairly common occurrence. Needless to say, the hand clinching of the strap about the lamp frames and glass stem was both costly and inefficient.

The present inventors have developed a mechanism for automatically crimping multiple straps for holding the frames about the glass stem. The mechanism provides proper alignment and radial orientation of the frames. The proper alignment results in part from pressure-relieving interlocks and a double clinching of the bands at opposite pole centers of the strap. The mechanism applies more uniform and equal forces at these opposite pole centers. The uniformity in the application of opposing clamping forces is more tolerant to deviations that can arise in the glass stem diameter.

The mechanism of this invention utilizes a pivot point forming tool that initiates a proper wrapping of the interlocking portions of the strap around the stem. The forming tool is spring loaded, to apply greater uniformity of force. Two oppositely-directed crimping tools cam over the crimping sections of the straps, after the initial forming procedure. At approximately thirty degrees past the horizontal working plane, the straps are locked into their final position. The fold-over configuration of each interlocking portion of each of the straps allows for material to be pulled back from each interlock portion as its respective crimping tool is operative. The pull-back of material releases tension along the straps during crimping. The variability in glass stem diameters among lamp units is no longer a factor in banding strap tension. Thus, stem breakage is now substantially eliminated.

The crimps that are formed are very compact, and the interlocking portions are physically as close as possible to the glass stem. This compactness resolves the inability of the prior hand procedure to control the final sub-assembly envelope diameter. In other words, the present inventive mechanism provides a more uniform product.

DISCLOSURE OF THE INVENTION

In accordance with one aspect of the present invention, there is provided a mechanism for fabricating a metalarc lamp that comprises a glass stem, mount frames, and a pair of banding strap for circumferentially encompassing and binding the mount frames to the glass stem. The mechanism defines a horizontal plane for the mount frames. The banding straps are mechanically clamped about the glass stem at opposite pole centers, thus affixing the alignment of the mount frames with respect to the glass stem. The mechanism comprises two oppositely opposed clamping blocks, each having a V-shaped clamping configuration. The clamping blocks locate and clamp the mount frames to the glass stem. Two oppositely directed forming tools then slidably engage with interlocking portions of the banding strap, located at opposite pole centers. The pole centers are positioned at approximately ninety degrees from each of the mount frames. The engagement of the forming tools with the banding strap at each pole center initiates the crimping process, wherein the straps lock the mount frames into proper orientation with the glass stem. Two oppositely directed crimping tools cam over the interlocking portions of the strap after the initial forming procedure. At approximately thirty degrees past the horizontal working plane, the straps are locked into their final position. The fold-over configuration of each interlocking portion of the strap allows for material to be pulled back from each interlock portion as its respective crimping tool is operative. The pull-back of material during the crimping procedure releases tension along the strap. The variability in glass stem diameters among lamp units is no longer a factor in proper banding strap tension. Thus, stem breakage is now substantially eliminated. The crimps that are formed are very compact, and the interlocking portions are physically as close as possible to the glass stem.

It is, therefore, an object of the invention to obviate the disadvantages of the prior art.

It is another object of the present invention to provide a new mechanism for fabricating metalarc lamps.

It is another object of this invention to provide a mechanism for crimping a banding strap and mount frames to a glass stem of a lamp unit.

It is a further object of the invention to provide a mechanism that automatically and uniformly crimps mount frames in a proper orientation with respect to a glass stem of a lamp, thus forming a compact lamp assembly.

BRIEF DESCRIPTION OF THE DRAWINGS

For purposes of brevity and clarity, like elements and components will bear the same designation and numbering throughout the FIGS.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Generally speaking, the invention features a mechanism for fabricating a mount assembly for a metalarc lamp. The metalarc lamp comprises a glass stem, mount frames, and a banding strap for circumferentially encompassing and binding the mount frames to the glass stem. The mechanism defines a horizontal plane for the mount frames. The banding straps are mechanically clamped about the glass stem at opposite pole centers, and then interlocking portions of the banding strap are crimped to affix the mount frames with respect to the glass stem.

Figure 1:
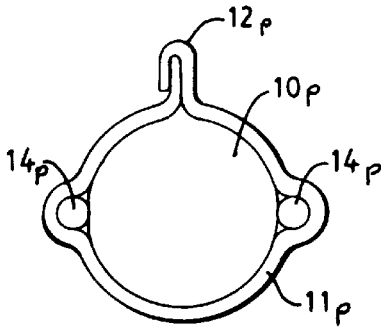
FIG. 1 (PRIOR ART)
FIG. 1 illustrates a plan view of a portion of a prior art metalarc lamp comprising a single banding strap disposed over mount frames and a glass stem, with the banding strap comprising only one interlock section.

Now referring to FIG. 1, the glass stem portion 10*p* and mount frames 14*p* of a metalarc lamp (not shown) are illustrated with a prior art banding strap 11*p* in place. The banding strap 11*p* comprises only one interlocking crimp section 12*p* (depicted in an non-crimped position), which is subsequently crimped by hand. The banding strap 11*p* circumferentially surrounds the glass stem 10*p* and the two mount frames 14*p*, as illustrated.

Figure 2:
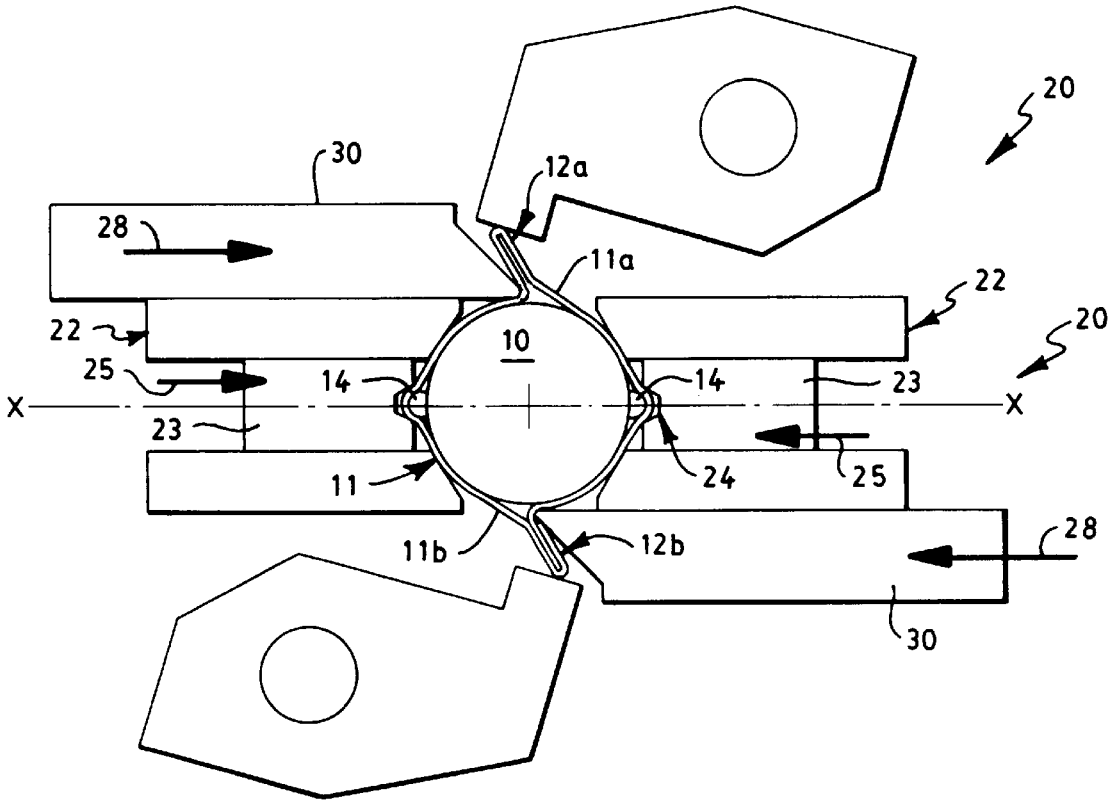
FIG. 2 depicts a plan view of a fabricating mechanism in a first position.
Figure 2A:
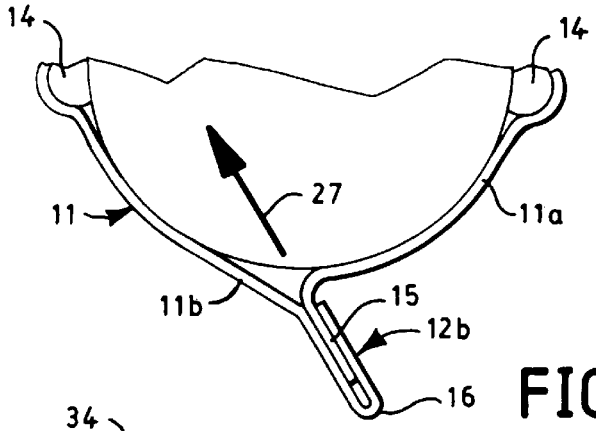
FIG. 2*a* shows an enlarged plan view of one of the interlocking sections of a banding strap disposed in the pivotally formed position, as depicted in FIG. 2.

Referring to FIG. 2, the glass stem portion 10 of the mounting assembly 9 of the lamp 1 of FIG. 1 is shown disposed within a fabricating mechanism 20 in accordance with this invention. An interlocking crimp section 12*b* and a solid crimp section 12*a*, (collectively referred to as crimping sections) are illustrated for the banding strap 11. A second banding strap (not shown) is similarly formed with an interlocking crimp section and a solid crimp section and is positioned beneath strap 11; however, the second banding strap is reversed from strap 11, i.e., the interlocking crimp section of the second strap is beneath the solid crimp section of strap 11. The interlocking crimp sections are diametrically disposed at opposite pole centers, and are formed at the ends of the two banding strap sections. Each end 15 of a respective banding strap is free to slide out (arrow 27) of the folded-over, coined section 16, as shown in greater detail in FIGS. 3 and 3*a*. The ability of the end 15 to slide from within the coined, folded-over, section 16 is of paramount importance in providing an adjustable tension throughout the banding straps during the crimping operation, as will be more fully explained hereinafter, with respect to FIGS. 3 and 3*a*.

The mechanism 20 of this invention comprises two stem strap clamping tools 22. Each strap clamping tool 22 has a center portion 23 having a V-shaped mouth that engages the banding strap 11 about one of the mount frames 14, as shown. The clamping tools 22 are each slid into place about their respective mount frames 14, as illustrated by arrows 25. The clamping tools 22 capture and position the banding strap 11 and mount frames 14 with respect to the glass stem 10. After the mount frames 14 have been located with respect to the glass stem 10, two pivot point forming tools 30 are caused to engage with the interlocking crimp section 12*b* and the solid crimp section 12*a*. This result is achieved by sliding (arrow 28) the forming tools 30 into position.

At approximately thirty degrees past the horizontal working plane X—X, as illustrated in FIG. 2, the strap 11 is locked into its final position, as shown in FIGS. 3, 3*a*, 4, and 4*a*.

Figure 3:
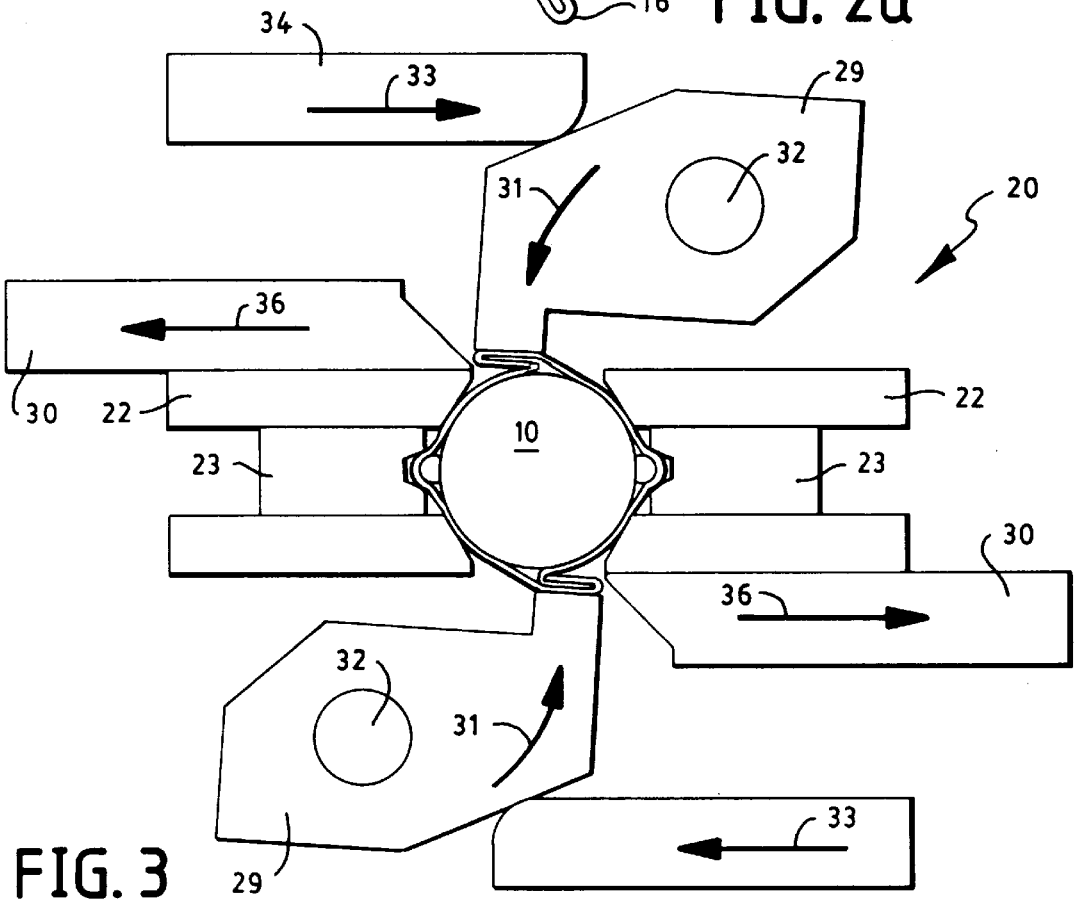
FIG. 3 is a plan view of the fabricating mechanism in a second position.
Figure 3A:
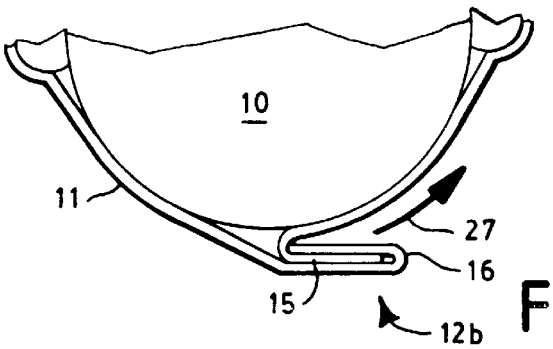
FIG. 3*a* depicts an enlarged plan view of one of the interlocking sections of a banding strap of FIG. 3, with the interlocking section in its respective crimped, pullback position.

Referring to FIGS. 3 and 3*a*, the crimping operation is illustrated. The crimping hammers 29 are pivotable about pivot point 32. The crimping hammers 29 swing into contact with the respective interlocking portions 12*a* and 12*b*, as shown by arrows 31. The crimping hammers 29 are caused to pivot into engagement with the crimping sections 12*a* and 12*b* by means of the respective closure crimp form tools 34. The closure crimp form tools 34 slide (arrows 33) into engagement with the crimping hammers 29, thus causing them to pivot about point 32 and to contact interlocking portions 12*a* and 12*b*, as shown.

The fold-over configuration of the interlocking portion 12*b* of the strap 11 allows for each end portion 15 to be pulled back (arrow 27) from each folded-over section 16, as its respective crimping tool 29 is operative, as shown in FIG. 3*a*. The pull-back of the end portions 15 during the crimping procedure releases tension along the strap 11. Similar action occurs for the lower strap.

It should be observed that when the closure crimp form tools 34 are slidably operative against their respective crimping hammers 29, the pivot point forming tools 30 are caused to retract, as illustrated by arrows 36.

Figure 4:
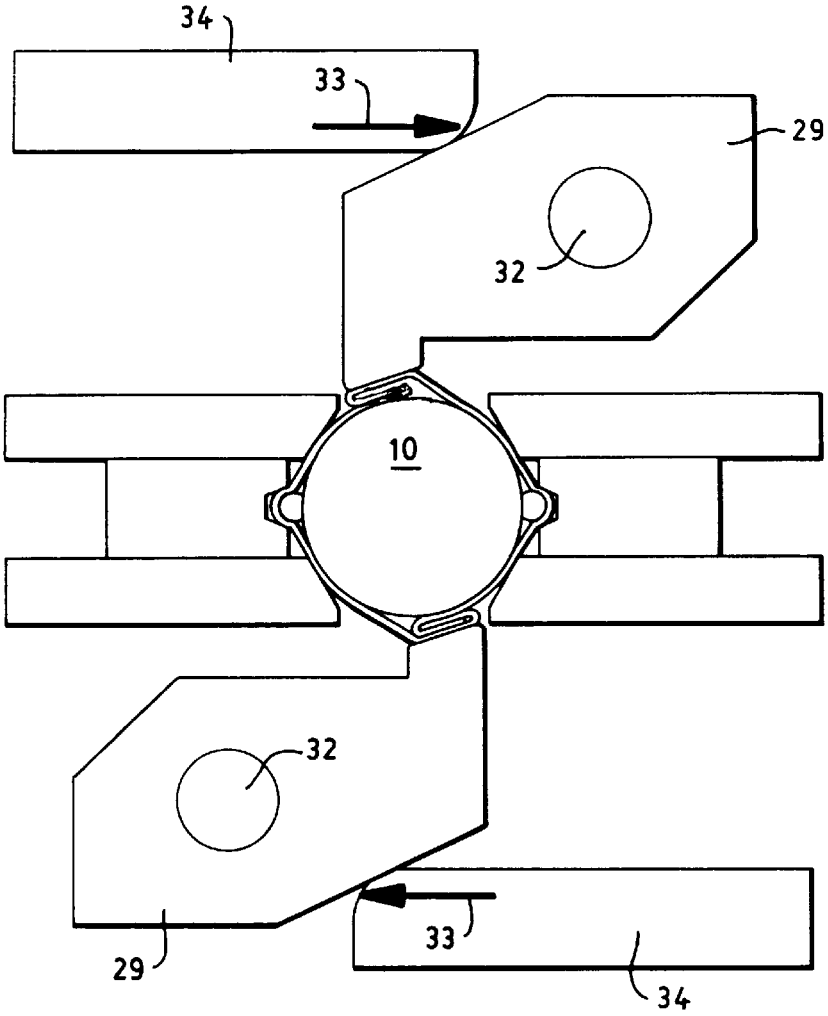
FIG. 4 is a plan view of the fabricating mechanism in a third position.
Figure 4A:
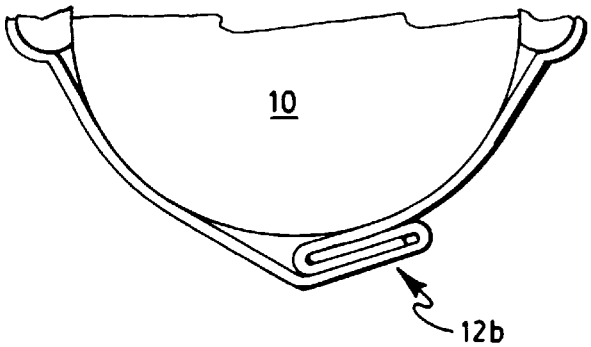
FIG. 4*a* depicts an enlarged plan view of one of the interlocking sections of the banding strap of FIG. 4, with the interlocking section shown in its respective, fully crimped position.

Referring to FIGS. 4 and 4*a*, the final crimp position is shown for the crimp sections 12*a* and 12*b*. In this position, the crimping hammers 29 have fully pivoted about pivot points 32, and the closure crimp form tools 34 have been fully extended (arrows 33) against the crimping hammers 29. It will be observed from FIG. 4*a* that the crimp sections 12*a* and 12*b* are compacted against the glass stem 10, presenting a very low and compact profile.

It should be understood that all of the various movable parts of the mechanism 20 are timed to interact with each other to provide a proper sequence of movement in order to accomplish each of the crimping events described above.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A lamp fabricating mechanism, comprising:

a pair of clamping tools for locating and securing a banding strap containing a pair of mount frames about a lamp stem, said banding strap comprising a pair of oppositely disposed crimping sections to be crimped, wherein said banding strap holding said mount frames in place is permanently secured about said lamp stem;

a pair of movable forming tools disposed adjacent said lamp stem and said crimping sections for movably engaging with, and subsequently retracting from said crimping sections, said forming tools causing an initiation of a crimping of said crimping sections; and a pair of oppositely movable crimping hammers disposed adjacent said lamp stem and said crimping sections, said crimping hammers camming over said crimping sections of the banding strap, after said pair of movable forming tools is movably retracted from engagement with said crimping sections.

2. The lamp fabricating mechanism in accordance with claim 1, including means wherein said crimping sections of the banding strap are formed at approximately thirty degrees past a horizontal working plane by said pair of movable forming tools, said pair of movable forming tools then retracting, and said banding strap then being secured into its final position about said lamp stem by said pair of oppositely movable crimping hammers.

3. The lamp fabricating mechanism in accordance with claim 1, including means wherein each crimping section of said banding strap comprises a fold-over configuration, each crimping section of the banding strap allowing for a portion of banding strap material to be pulled back from each crimping section as each crimping hammer is operative, whereby said pull-back releases tension along the banding strap during the crimping thereof.

4. The lamp fabricating mechanism in accordance with claim 1, further including closure means for pivoting said pair of oppositely movable crimping hammers into engagement with each crimping section of said banding strap.

5. A lamp fabricating mechanism, comprising:

a pair of oppositely disposed clamping tools for locating and securing a banding strap containing a pair of mount frames about a lamp stem, said banding strap comprising a pair of oppositely disposed foldable crimping sections to be crimped about said lamp stem, wherein said banding strap holding said mount frames in place is permanently secured about said lamp stem;

a pair of oppositely movable forming tools disposed adjacent said lamp stem and said crimping sections for movably engaging with, and subsequently retracting from said crimping sections, said forming tools causing an initiation of a crimping of said crimping sections by partially folding over said crimping sections; and a pair of oppositely movable crimping hammers disposed adjacent said lamp stem and said crimping sections, said crimping hammers camming over said crimping sections of the banding strap after said pair of movable forming tools is movably retracted from engagement with said crimping sections.

6. The lamp fabricating mechanism in accordance with claim 5, including means wherein said crimping sections of the banding strap are formed at approximately thirty degrees past a horizontal working plane by said pair of movable forming tools, said pair of movable forming tools then retracting, and said banding strap then being secured into its final position about said lamp stem by said pair of oppositely movable crimping hammers.

7. The lamp fabricating mechanism in accordance with claim 5, including means wherein each crimping section of said banding strap comprises a fold-over configuration, each crimping section of the banding strap allowing for a portion of banding strap material to be pulled back from each crimping section as each crimping hammer is operative, whereby said pull-back releases tension along the banding strap during the crimping thereof.

8. The lamp fabricating mechanism in accordance with claim 5, further including closure means for pivoting said pair of oppositely movable crimping hammers into engagement with each crimping section of said banding strap.

9. A lamp fabricating mechanism, comprising:

a pair of oppositely disposed clamping tools for locating and securing a banding strap containing a pair of mount frames about a lamp stem, said banding strap comprising a pair of oppositely disposed foldable crimping sections to be crimped about said lamp stem, wherein said banding strap holding said mount frames in place is permanently secured about said lamp stem;

a pair of oppositely movable forming tools disposed adjacent said lamp stem and said crimping sections for movably engaging with, and subsequently retracting from said crimping sections, said forming tools causing an initiation of a crimping of said crimping sections by partially folding over said crimping sections;

a pair of oppositely pivotable crimping hammers disposed adjacent said lamp stem and said crimping sections, said crimping hammers camming over said crimping sections of the banding strap after said pair of movable forming tools is movably retracted from engagement with said crimping sections; and closure means for pivoting said pair of oppositely movable crimping hammers into engagement with each crimping section of said banding strap.

10. The lamp fabricating mechanism in accordance with claim 9, including means wherein said crimping sections of the banding strap are formed at approximately thirty degrees past a horizontal working plane by said pair of movable forming tools, said pair of movable forming tools then retracting, and said banding strap then being secured into its final position about said lamp stem by said pair of oppositely movable crimping hammers.

11. The lamp fabricating mechanism in accordance with claim 9, including means wherein each crimping section of said banding strap comprises a fold-over configuration, each crimping section of the banding strap allowing for a portion of banding strap material to be pulled back from each crimping section as each crimping hammer is operative, whereby said pull-back releases tension along the banding strap during the crimping thereof.

* * * * *